US005806689A

United States Patent [19]

Mays et al.

[11] Patent Number: 5,806,689

[45] Date of Patent: Sep. 15, 1998

[54] GRAVITY FEED, MODULAR SHELVING SYSTEM

[75] Inventors: Gary L. Mays, Edina, Minn.; M. Scott Bryson, Brookfield; Allen E. Johnson, Hartford, both of Wis.

[73] Assignee: General Mills, Inc., Minneapolis, Minn.

[21] Appl. No.: 804,565

[22] Filed: Feb. 24, 1997

[51] Int. Cl.[6] ..... A47F 1/04

[52] U.S. Cl. ..... 211/59.2; 211/187; 211/90.01; 108/108

[58] Field of Search ..... 108/108, 110, 108/143, 61; 312/408; 211/59.2, 74, 184, 186, 187, 90.01

[56] References Cited

U.S. PATENT DOCUMENTS

| | | | |
|---|---|---|---|
| 2,239,369 | 4/1941 | Nauert | 312/408 X |
| 4,228,903 | 10/1980 | Eckert | 211/59.2 |
| 4,423,818 | 1/1984 | Spamer | 211/59.2 |
| 4,454,948 | 6/1984 | Spamer | 211/59.2 |
| 4,565,725 | 1/1986 | Spamer et al. | 211/59.2 X |
| 4,651,883 | 3/1987 | Gullett et al. | 211/59.2 |
| 4,690,287 | 9/1987 | Fershko et al. | 211/59.2 X |
| 4,785,943 | 11/1988 | Deffner et al. | 211/59.2 |
| 4,790,707 | 12/1988 | Magretta et al. | 211/187 X |
| 4,801,025 | 1/1989 | Flum et al. | 211/59.2 |
| 5,022,535 | 6/1991 | Spamer | 211/59.2 |
| 5,088,607 | 2/1992 | Risafi et al. | 211/187 X |
| 5,197,610 | 3/1993 | Bustos | 211/59.2 |
| 5,417,333 | 5/1995 | Flum . | |
| 5,564,346 | 10/1996 | Robben | 211/187 X |
| 5,593,408 | 1/1997 | Johnson | 211/59.2 |

*Primary Examiner*—Peter M. Cuomo
*Assistant Examiner*—Hanh V. Tran
*Attorney, Agent, or Firm*—L. MeRoy Lillehaugen; John A. O'Toole; Alan D. Kamrath

[57] ABSTRACT

A shelving system (10) includes an upper shelf (42) exclusively supported by and at differing vertical spacings from a lower shelf (16) which can be removably attached to an outside support in the preferred form of a refrigerator case (12). Each of the shelves (16, 42) include support panels (32, 56) for removable securement of trays (62) including upright walls (70) for retaining differing types of yogurt containers in a straight line. For containers where the bases include the largest horizontal dimension, the upright walls (70) are formed on the outside edges of the trays (62). For containers having the maximum horizontal dimension other than at the base, the trays (62) include first and second protrusions (71) extending beyond the upright walls (70) to an extent generally equal to the maximum horizontal dimension of the containers. The trays (62) each include flexible stops (72) for preventing product from sliding off their front edges and providing cushioning and stopping of sliding product. The trays (62) are inclined at a gentle angle sufficient to start sliding of product on the trays under gravitational forces and include ribs (68) upon which the planar bases of the products slide and are supported to reduce static friction.

20 Claims, 4 Drawing Sheets

GRAVITY FEED, MODULAR SHELVING SYSTEM

BACKGROUND

The present invention generally relates to shelving systems, particularly to shelving systems for gravity feeding cup type products, more particularly to modular, gravity feed, shelving systems, and specifically to modular, gravity feed, shelving systems for fragile products such as individual thin wall containers of a refrigerated product having thixotropic properties.

Yogurt is an example of refrigerated products having thixotropic properties which are sold in individual cups or containers in supermarkets and the like. Traditionally, yogurt is sold in refrigerator cases including horizontal shelves upon which yogurt containers having planar bases and tops are stacked on each other up to three high.

Often, the refrigerator cases are accessible only from the front, but some refrigerator cases have rear access doors. It should be appreciated that as consumers purchase product, they take product from the shelf generally in the front. Thus, it is necessary for the consumers to reach further back in the refrigerator case as product is being sold. Especially for upper shelves and/or shorter consumers, reaching the back of the refrigerator cases may be difficult. Thus, it is a common practice for store personnel to periodically move product from the rear of the shelf and to stack it adjacent the front. In addition for maximum appeal, it is desired to have the front of the container face the consumer so that it is necessary for store personnel to take the time to take note of the front of the container when stocking the shelves and to periodically rotate product on the shelves that consumers move on the shelf. Additionally, when restocking product, it is desirable that the newer product be placed behind the older product so that consumers purchase the older product to minimize shelf time for any particular product. It is thus necessary for front loading shelves to remove product on the shelf, to place the new product on the rear of the shelf, and then replace the removed product on the front of the shelf in front of the new product. As the product is stacked three high, all of these operations are very labor intensive and significantly increase the cost of retailing such products.

Another significant difficulty in displaying products such as yogurt is that the shapes and sizes of the cups vary between manufacturers and even between varieties for the same manufacturer. As an example, many cups are of a frusto-conical shape but some have the top being of the smaller dimension while others have the top being the larger dimension. It is often desirable to change the type of product being sold at any particular volume in the refrigerator case. Thus, it is necessary for the shelving system to accommodate varying products. Although horizontal shelves on which product is stacked can easily accommodate various types of products, it suffers from the deficiencies previously set forth as well as others.

Gravity feed systems are known to move product towards the front of display or storage cases. As an example, many cylindrical products are dispensed by rolling down an incline. Another common example is in the retailing of chilled beer where packages of individual servings of cans or bottles of beer roll down a wheeled incline to the front of a refrigerator case. Also, upper shelves inclined at large angles in the order of 10° to 15° have been utilized for large, one or two liter plastic bottles of soda in grocery stores. Although very well known in other fields for long periods of time, gravity feed systems have not been utilized for relatively fragile products such as individual thin wall containers of a refrigerated product having thixotropic properties and in particular to vacuum formed plastic or paper containers of yogurt. Thus, retailing of yogurt and similar products have not obtained the benefit of gravity feed and particularly movement of the product to the front of the refrigerator case so that it is not necessary for the consumer to reach further back in the refrigerator case as product is being sold and/or require store personnel to move and stack the product adjacent to the front of the refrigerator case.

Thus, a need exists for shelving systems which allow the stocking and display of individual cup type products such as yogurt for sale and which minimize the labor required and otherwise overcomes the deficiencies of prior shelving systems.

SUMMARY

The present invention solves this need and other problems in the field of shelving systems by providing, in the preferred form, trays for holding a plurality of relatively fragile products such as planar base, thin walled containers of a refrigerated product having thixotropic properties in a single lane and at a gentle angle in the order of 5.5° so that the bases of the containers tend to slide on the tray under gravitational forces and without other external forces while keeping the speed of the sliding containers from being too fast so that the containers flip out or otherwise leave the tray.

In a further aspect of the present invention, a flexible stop extends over the front edge of an inclined tray and extends to a height in the range of one-third to one-half of the height of the product on the tray, with the stop having a flexibility to allow flexing when the initial product is manually removed from the front of the tray, to allow its return to a stopping position after the initial product is removed to abut with the succeeding product, and to allow cushioning of and stopping the succeeding product sliding toward the front edge of the tray.

In another aspect of the present invention, the shelving system is of a modular construction where trays for holding different types of products having differing shapes and sizes can be removably secured to a shelf, with the trays having provisions for retaining the product of a particular type in a straight line so that the trays can be interchanged on the shelf according to the particular type(s) of products desired to be held in the shelving system.

In still a further aspect of the present invention, the shelving system includes a first shelf adapted to be removably attached to an outside support and includes a second shelf exclusively supported by the first shelf at differing spacings, with the second shelf being of lighter weight material as it supports less weight than the first shelf and the combined first and second shelves taking less vertical space than two shelves removably attached to the outside support for increasing the vertical efficiency of the shelving system.

It is thus an object of the present invention to provide a novel shelving system.

It is further an object of the present invention to provide such a novel shelving system for gravity feeding relatively fragile products.

It is further an object of the present invention to provide such a novel shelving system for gravity feeding at a gentle incline angle.

It is further an object of the present invention to provide such a novel shelving system of a modular design.

It is further an object of the present invention to provide such a novel shelving system maximizing vertical efficiency.

It is further an object of the present invention to provide such a novel shelving system for products having thixotropic properties.

It is further an object of the present invention to provide such a novel shelving system for individual thin walled containers having planar bases.

It is further an object of the present invention to provide such a novel shelving system for containers of yogurt.

It is further an object of the present invention to provide such a novel shelving system having a flexible, transparent front stop.

It is further an object of the present invention to provide such a novel shelving system having a shock-absorbing front stop.

It is further an object of the present invention to provide such a novel shelving system including inter-changeable trays for holding differing types of products.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
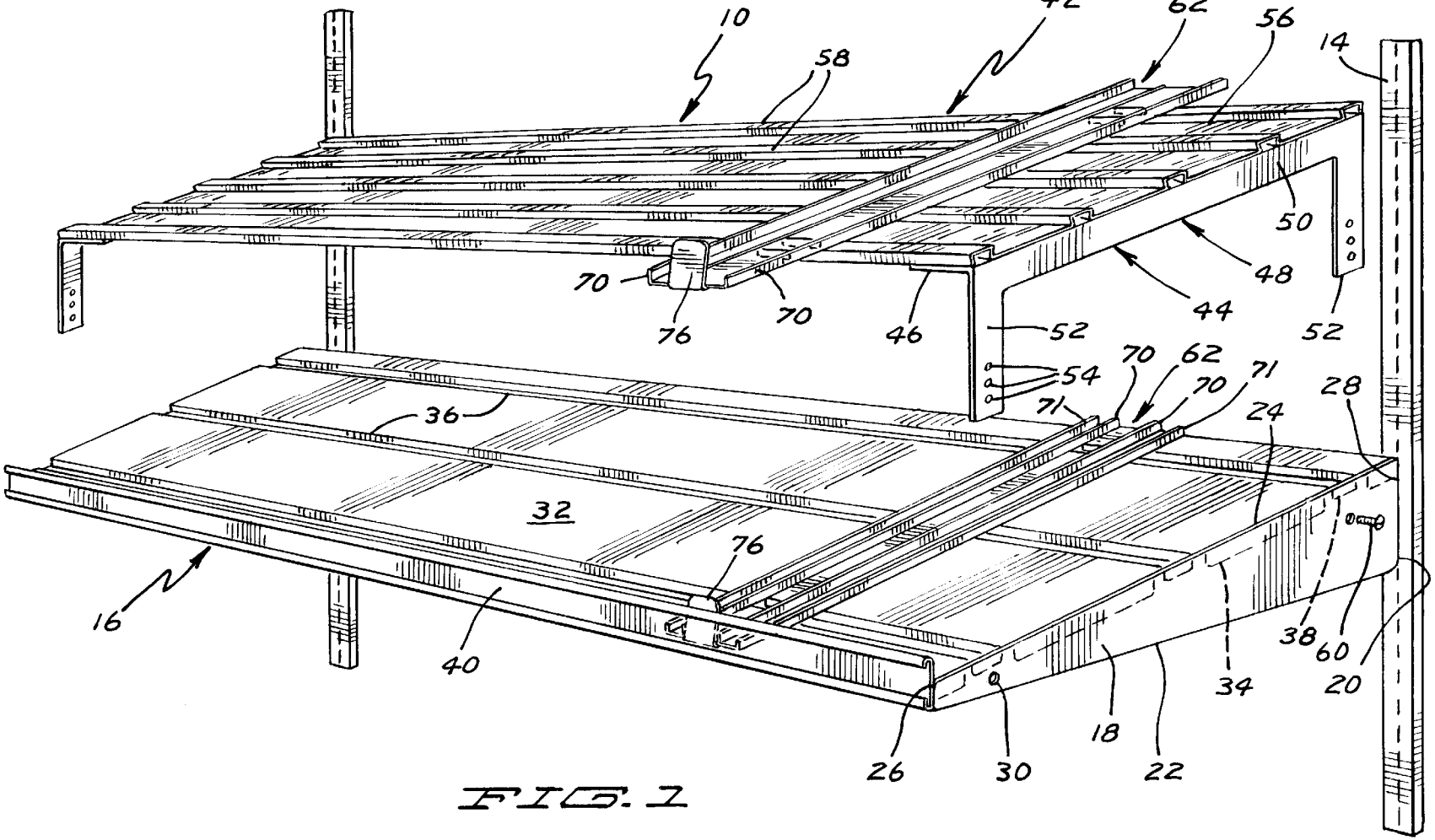
FIG. 1 shows an exploded, perspective view of a shelving system according to the preferred teachings of the present invention for holding and displaying thin walled containers of yogurt.
Figure 2:
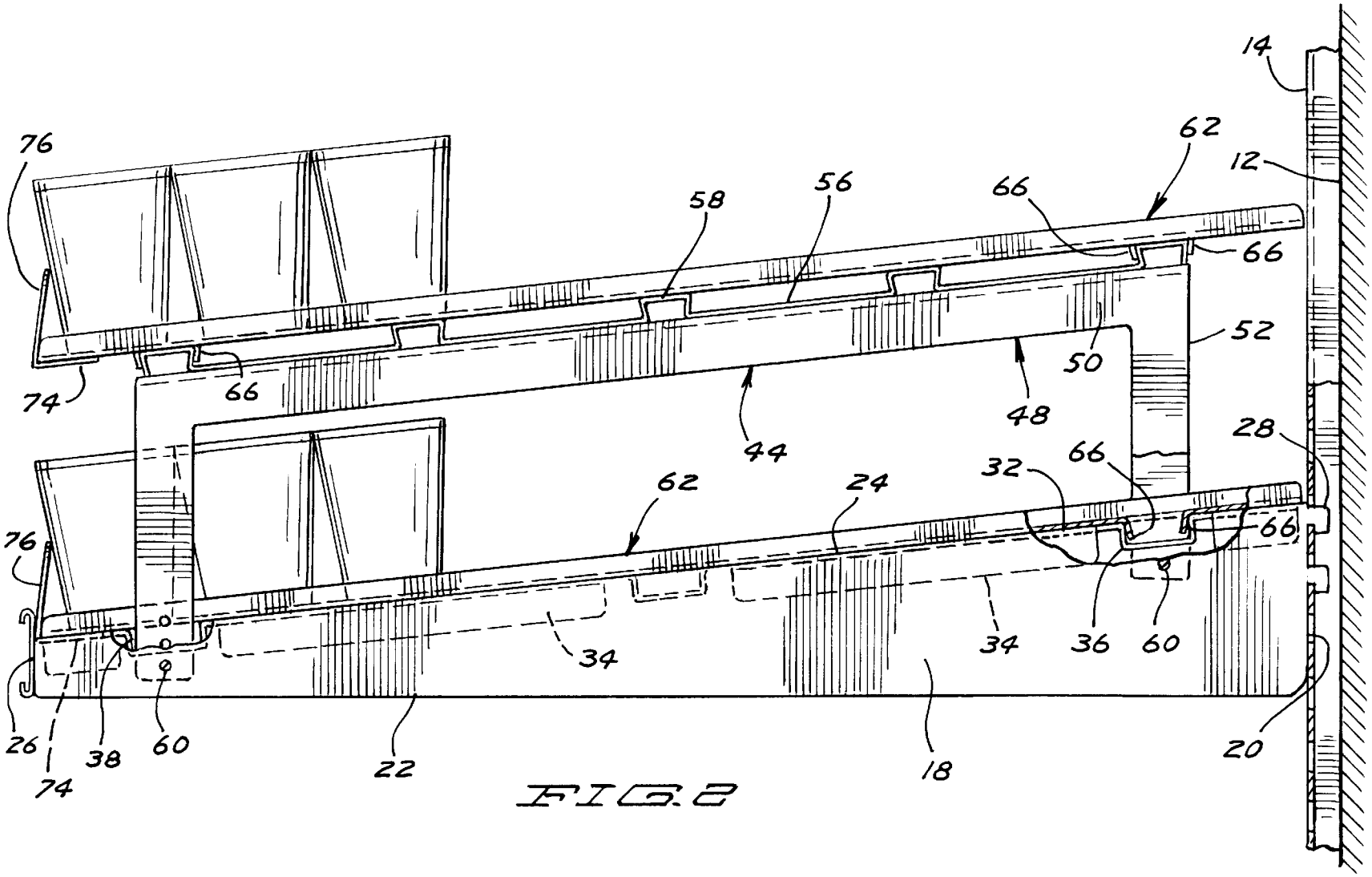
FIG. 2 shows a side view of the shelving system of FIG. 1, with portions shown in phantom or broken away to show constructional details.
Figure 3:
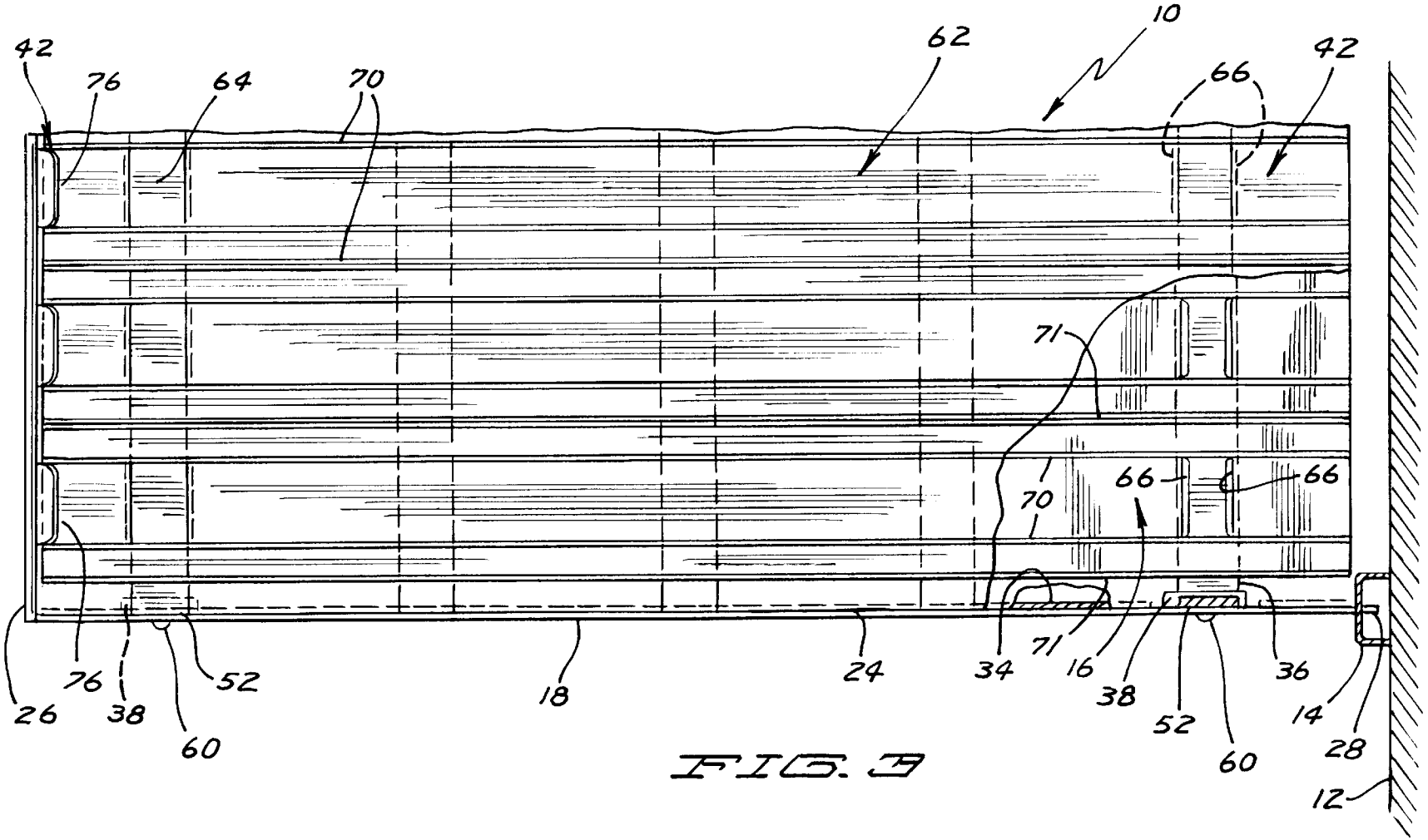
FIG. 3 shows a partial, top view of the shelving system of FIG. 1, with portions broken away to show constructional details.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has have been read and understood.

Where used in the various figures of the drawings, the same numerals designate the same or similar parts. Furthermore, when the terms "top", "bottom", "first", "second", "front", "back", "rear", "inner", "upper", "lower", "height", "width", "length", "end", "side", "horizontal", "vertical", "longitudinal", and similar terms are used herein, it should be understood that these terms have reference only to the structure shown in the drawings as it would appear to a person viewing the drawings and are utilized only to facilitate describing the illustrative embodiment.

DESCRIPTION

A shelving system according to the preferred teachings of the present invention is shown in the drawings and generally designated 10. In the preferred form, shelving system 10 is utilized in a conventional refrigerator case 12 utilized in supermarkets or the like. Refrigerator case 12 includes an outside support having suitable provisions 14 for the removable attachment of shelves such as parallel, spaced, vertically extending strips having multiple, vertically spaced, vertically elongated slots.

System 10 generally includes a lower shelf 16 having first and second shelf brackets 18 of a generally wedge shape. Specifically, brackets 18 are generally planar and each has a vertical rear edge 20, bottom edge 22 extending generally perpendicular to rear edge 20 and in the most preferred form at an angle in the order of 88° to rear edge 20, a top edge 24 extending at a gentle downward angle towards bottom edge 22 and in the most preferred form at an angle in the order of 84.5° to rear edge 20, and a vertical front edge 26 generally parallel to rear edge 20. Brackets 18 include attachment elements 28 for cooperating with provisions 14 of refrigerator case 12 such as integrally formed L-shaped tabs in the most preferred form for insertion and sliding in the vertically elongated slots of the preferred form of provisions 14 in a well known manner. First and second apertures 30 are formed in brackets 18 adjacent to but spaced from edges 20 and 26 and equally spaced from edge 24.

Lower shelf 16 further includes a support panel 32 having a length generally equal to the horizontal spacing between provisions 14 and a width generally equal to the spacing between edges 20 and 26 of brackets 18. Panel 32 is suitably secured to and between first and second brackets 18 such as by welding flaps 34 bent downwardly from the ends of panel 32. Panel 32 includes a plurality of parallel, spaced grooves or channels 36 extending generally perpendicular to brackets 18. In the most preferred form, channels 36 are generally U-shaped having side walls extending generally perpendicular to the bottom wall of channels 36. Panel 32 includes first and second elongated slots 38 at each end adjacent to brackets 18 and generally aligned with apertures 30. In the most preferred form, slots 38 are located in the ends of channels 36 adjacent to edges 20 and 26 of brackets 18.

In the most preferred form, lower shelf 16 further includes a conventional price channel 40 suitably secured to the front edge of panel 32 and edges 26 of brackets 18 such as by welding. Price channel 40 receives and allows horizontal sliding of price cards as conventional.

System 10 generally includes an upper shelf 42 having first and second support structures 44 of a generally L-shape. Specifically, each structure 44 includes a planar, rectangular flap 46 and a U-shaped member 48 bent generally perpendicular to flap 46. Member 48 includes a central member 50 having an upper edge bent perpendicularly from and integrally formed with flap 46 and first and second legs 52 extending generally perpendicular to member 50. The lower ends of legs 52 include multiple, vertically spaced apertures 54. Legs 52 have a size and shape for slideable receipt in slots 38 of lower shelf 16.

Upper shelf 42 further includes a support panel 56 having a length generally equal to that of panel 32 and a width slightly less than that of panel 32. Panel 56 is suitably secured to and between first and second support structures 44 such as by welding to flaps 46. Panel 56 includes a plurality of parallel, spaced protrusions 58 extending generally perpendicular to members 48. In the most preferred form, protrusions 58 have cross sections in the shape of an isosceles trapezoid having its major base located above the minor base. In the most preferred form, protrusions 58 are positioned at locations corresponding to channels 36 and also intermediate channels 36.

System 10 further generally includes attachment members 60 such as screws as shown for securing legs 52 to brackets 18. Screws 60 extend through apertures 30 of lower shelf 16 and one of the apertures 54 in legs 52 of upper shelf 42 depending upon the desired spacing between panels 32 and 56. Further, it can be appreciated that the spacing between panels 32 and 56 can be adjusted by removing screws 60 and insertion in apertures 54 in legs 52 at the spacing desired at any particular time.

According to the preferred teachings of the present invention, upper shelf 42 does not include provisions for direct attachment to refrigerator case 12 but is exclusively supported above and by lower shelf 16. Further, due to the provisions of multiple apertures 54, shelf 42 can be adjustably secured to shelf 16 at differing spacings between panels 32 and 56 of shelves 16 and 42. It can then be appreciated that shelf 42 can be formed of lighter weight material than shelf 16 as it supports less weight than shelf 16 and shelf 42 can be fabricated to minimize its vertical dimensions so that shelves 16 and 42 according to the teachings of the present invention takes less vertical space than two shelves 16 each removably attached to refrigerator case 12 for increasing the vertical efficiency of shelving system 12 according to the preferred teachings of the present invention.

System 10 further includes a plurality of trays 62 removably securable to panels 32 and 56, with each tray 62 intended to hold one lane of products. Specifically, each tray 62 generally includes a planar sheet 64 having a width generally equal to that of panel 32 and a width generally equal to the largest horizontal dimension of the products desired to be held. Each tray 62 further includes provisions 66 for cooperating with channels 36 or protrusions 58 for removably holding tray 62 to panels 32 and 56. In the most preferred form, protrusions 66 include first and second flexible lips extending toward each other at an angle corresponding to the angle of the sidewalls of protrusions 58. It should then be noted that lips 66 can be inserted in channels 36 or snapped over protrusions 58. Trays 62 are allowed to slide in a direction parallel to channels 36 and protrusions 58, and prevented from moving horizontally in a direction perpendicular to channels 36 and protrusions 58 due to the abutment of lips 66 with the sidewalls of channels 36 and protrusions 58, and are prevented from moving downward due to the abutment of their lower surfaces with the upper surfaces of panels 32 and 56. However, trays 62 can be removed by raising trays 62 to remove lips 66 from channels 36 or protrusions 58. In the most preferred form, lips 66 are provided for only the first and last channels 36 and protrusions 58 and not the intermediate ones. However, if desired or necessary, lips 66 can be provided for intermediate channels 36 and protrusions 58.

In the most preferred form when elements 28 are received in provisions 14, edges 20 would be vertical and top edges 24 would slope vertically downward at a gentle incline in the order of 5.5°. Panels 32 and 56 and trays supported thereon would be similarly sloped downwardly. It should then be noted that product supported upon sheet 64 of trays 62 will tend to slide toward the front edge of trays 62. To reduce the sliding friction and enhance this sliding tendency, sheets 64 include parallel, longitudinally extending ribs 68 upstanding therefrom which engage the bases of the product. Specifically, the area of abutment of the bases of the product is only the tops of ribs 68 and not the total area of sheets 64. As sliding friction is directly related to area of abutment, ribs 68 produce a substantial friction reduction. In addition or alternatively, the top surfaces of trays 62 can be treated, impregnated or coated with a friction reducing agent such as silicone to reduce the coefficient of friction of trays 62.

It should be appreciated that it may be desirable to vary the sliding friction from the front to the back of trays 62. Specifically, to reduce momentum of product sliding adjacent the front of trays 62, increased friction can be provided adjacent the front of trays 62. This could be accomplished by many ways. For example, the front of trays 62 could have an increased number of ribs 68 adjacent the front compared to the back or the ribs 68 could be eliminated adjacent the front so that the area of abutment increases as the product slides towards the front. In addition or alternately, the amount of friction reducing agent treated, impregnated or coated could be decreased adjacent the front compared to the back.

Figure 4:
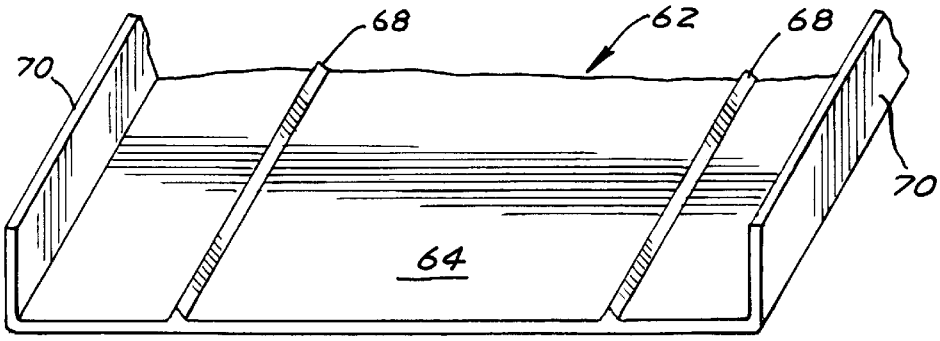
FIGS. 4 and 5 show partial, perspective views of trays for the shelving system of FIG. 1.

Trays 62 include suitable provisions 70 for retaining the product in a straight lane shown in the most preferred form as first and second, parallel, upright walls integrally extending generally perpendicular to planar sheet 64 and forming a channel having a width generally equal to the horizontal dimension of the bases of the products to be held thereon. In the most preferred form, trays 62 are of two styles. Particularly, for products whose bases include the largest horizontal dimension such as a frustoconical shape with its top being the smaller dimension, walls 70 are provided along both edges of tray 62 as shown in FIG. 4, with tray 62 having a width generally equal to the horizontal dimension of the base of the product. Thus, tray 62 of the style of FIG. 4 is generally U-shaped. It can be appreciated that when multiple trays 62 of the style of FIG. 4 are positioned on shelf 16 or 42, wall 70 of a first tray 62 abuts wall 70 of the adjacent tray 62. This arrangement minimizes the horizontal spacing between lanes of products while preventing interference between the lanes of the products to maximize horizontal efficiency.

Figure 5:
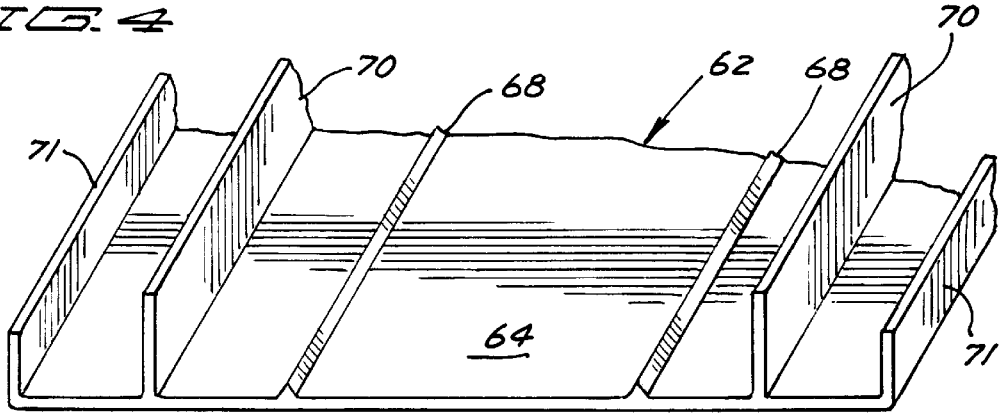
Figure 6:
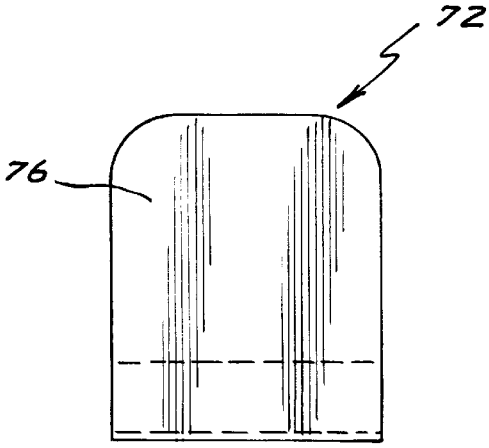
FIG. 6 shows a front elevational view of a flexible, transparent stop for the trays for the shelving system of FIG. 1.
Figure 7:
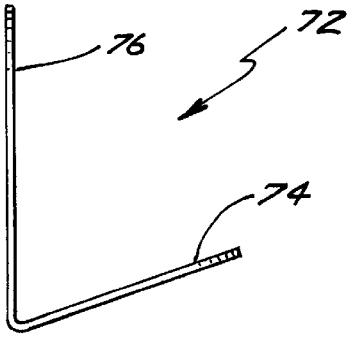
FIG. 7 shows a side view of a flexible, transparent stop for the trays for the shelving system of FIG. 1.

Alternately, for products whose bases include smaller dimensions than other portions of the products such as a frustoconical shape with the top being of a larger dimension, first and second, elongated, L-shaped protrusions 71 are provided as shown in FIG. 5 extending equadistant from the opposite edges of sheet 64 away from walls 70 to an extent generally equal to the maximum horizontal dimension of the product. In particular, each protrusion 71 includes a first leg extending contiguously and integrally with sheet 64 and a second leg extending generally perpendicularly from the free edge of the first leg and parallel to walls 70. In the preferred form, the second legs of protrusions 71 have a height less than walls 70, preferably in the order of two-thirds the height of walls 70, and in the most preferred form in the order of one-fourth inch (6.4 mm). When multiple trays 62 of the style of FIG. 5 are positioned on shelf 16 or 42, the second legs of protrusions 71 of adjacent trays 62 abut, with the bases of the product located intermediate the edges of tray 62 and the edges of tray 62 should have an extent equal to the maximum horizontal dimension of the product. This minimizes the horizontal spacing between lanes of products while preventing interference between the lanes of the products to maximize horizontal efficiency.

It should be appreciated that trays 62 of the style of FIG. 5 of different widths can be intermixed on shelf 16 or 42 as well as intermixed with trays 62 of the style of FIG. 4 and without interference between the lanes of the products held therein. When trays 62 of the styles of FIGS. 4 and 5 are positioned on shelf 16 or 42 adjacent to each other, wall 70 of tray 62 of the style of FIG. 4 will abut with the second leg of protrusion 71 of the adjacent tray 62 of the style of FIG. 5. It can be appreciated that the abutment of walls 70, the abutment of wall 70 and the second leg of protrusion 71, or the abutment of the second legs of protrusions 71 of adjacent trays 62 prevent trays 62 from sliding under one another on shelf 16 or 42 which could be a problem if trays 62 included planar sides.

In the most preferred form, trays 62 include flexible front stops 72. Specifically, stops 72 are generally V-shaped and include a flap 74 suitably secured to the lower surface of sheets 64 of trays 62 such as by adhesive. Stops 72 further include a planar upright 76 extending over the front edges of sheets 64 of trays 62 to a height generally equal to one-third to one-half of the heights of the products. Upright 76 is integral with flap 74 and extends at an acute angle thereto such as at an angle in the order of 70°. Stops 72 are formed of flexible material which is also preferably transparent such as clear polycarbonate. It should be appreciated that the rearward angle of uprights 76 relative to trays 62 and the flexibility of uprights 76 provide a resilient or cushioning stop when engaged by product as uprights 76 tend to bend forward and flex under forces due to the engagement of uprights 76 by sliding product.

Now that the basic construction of shelving system 10 according to the preferred teachings of the present invention has been set forth, a preferred method of use and some of the advantages of system 10 can be explained and appreciated. Specifically, for the sake of explanation, it will be assumed that system 10 is removed from refrigerator case 12. Specifically, after deciding what type of products are desired to be held and displayed in system 10, trays 62 for slideably supporting the bases of each type of product are selected and secured to panels 32 and 56 by positioning lips 66 on or into channels 36 and protrusions 58. In the preferred form, several different styles of trays 62 are provided and may be selected from. Additionally, trays 62 can be formed on a custom basis according to the particular type of products desired to be retailed. Depending upon the type of products to be held on trays 62 secured to lower shelf 16, the spacing between shelves 16 and 42 can be adjusted corresponding to the height of the products supported on lower shelf 16. System 10 can then be installed in refrigerator case 12 by inserting elements 28 into provisions 14 in the most preferred form.

After installation, product can be stocked in system 10. If rear access doors are provided in refrigerator case 12, product can be inserted on trays 62 adjacent their rear edges and will slide down trays 62 towards their front edges. If rear access is not provided, stop 72 can be flexed to allow products to be placed on trays 62, with the products on trays 62 being manually slid towards the rear edges of trays 62 as additional product is placed on trays 62. In any case, product tends to slide in trays 62 under gravitational forces towards the front edge, with the initial product in the single lane in each tray 62 abutting with upright 76 of stop 72.

When a consumer wishes to purchase a product, the consumer grasps the initial product from tray 62 and vertically raises it from tray 62 and moves it forward of tray 62. By doing so, stop 72 is bent and flexed allowing the initial product to be moved past stop 72 and removed from system 10. Depending upon the ratio of the height and diameter of the particular product, the initial product can be simultaneously tipped to minimize the dimension of the initial product between the top of stop 72 and the bottom of shelf 42 and/or trays 62 secured thereto so that the amount that stop 72 needs to be flexed is also minimized. The consumer can also grasp upright 76 or otherwise push upright 76 with his/her fingers or hand to flex stop 72 to allow removal of the initial product. After the initial product has moved past upright 76, upright 76 has a flexibility to allow its return to its stopping position to abut with the succeeding product in the single lane in tray 62.

After the initial product is removed from tray 62, the remaining product in the single lane in tray 62 will slide under gravitational forces towards the front edge of tray 62 until the succeeding product abuts with and is stopped by stop 72. It should be noted that due to the flexibility and rearward angle of stop 72, the succeeding product is cushioned by stop 72 as stop 72 will bend and/or flex upon its engagement by the succeeding product. Thus, the succeeding product moves to the front of shelving system 10 according to the teachings of the present invention so that it is no longer necessary for customers to reach further back in refrigerator case 12 as product is being sold or to have store personnel move product adjacent the front.

It should be appreciated that relatively fragile products, specifically individual thin wall containers of refrigerated products having thixotropic properties, and particularly containers of yogurt, have a tendency to flip or otherwise leave the support surfaces upon which they are supported if slid at too fast a speed because of their relatively light weight, their possibly high center of gravity and other characteristics of the products themselves as well as the momentum of multiple products sliding in a lane. This includes the initial product in the lane which engages the stop as well as succeeding products in the lane.

System 10 according to the teachings of the present invention is especially advantageous in overcoming this problem. Specifically, the cushioned stopping provided by flexible stop 72 absorbs some of the energy, the relatively high abutment of flexible stop 72 on the initial product as well as other features are the first line of defense to this problem.

Additionally, the gentle angle of trays 62 prevents the product from sliding too fast even if the initial product is placed adjacent to the rear edge of tray 62 and is allowed to slide the full longitudinal length to reach the front edge of tray 62. This is a major difference between other gravity feed approaches and especially gravity feed approaches where the products slide on the support surface. It has been found that if trays 62 were angled at 10° to 15° as in typical gravity feed approaches, containers of yogurt would slide too fast and the system would not be operative. The realization that a gentle angle could be utilized to gravity feed relatively fragile product was a major advancement in this field.

Also, the static friction of products in a stationary condition resists forces which tend to slide the product. Relatively fragile products typically have planar bases, i.e. bases which are supported by at least three nonlinear points. Examples of planar bases would include flat bottom containers or containers having annular lips around or adjacent the periphery of the bottom of the containers, with such lips extending around the entire or only partial periphery. As static friction is dependent on several factors including the area of abutment and the coefficient of friction of the bases of the products and of the support surfaces, the provision of ribs 68 or other friction reducing provisions is important to reduce the amount of force required to get the products to start sliding on trays 62. As trays 62 in the most preferred form are inclined at a gentle angle, the gravitational forces placed upon the products to slide in trays 62 is also reduced. Thus, the friction reducing provision is especially important in the preferred form of the present invention. Additionally, ribs 68 elevate the product above any spillage onto trays 62 which could result in products sticking to tray 62 or otherwise increasing the frictional forces which resist products from sliding in trays 62. However, it should be appreciated that friction between the products and trays 62 should be sufficient to keep the products from sliding too fast once they start sliding. If this is a problem, the amount of friction can be varied from the front to the back of trays 62 according to the teachings of the present invention.

It should be appreciated that due to its modular design, system 10 is especially advantageous in allowing the types of products to be held and displayed in refrigerator case 12 to be changed as desired. Specifically, trays 62 in system 10 for holding one type of product can be removed from shelf 16 and/or 42 and replaced with trays 62 for holding another type of product. Further, trays 62 for holding different types of products can be mixed and matched on shelves 16 and/or 42 as desired. It should be appreciated that the spacing between shelves 16 and 42 can be adjusted by removal and reinsertion of screws 60 and that the spacing between systems 10 in refrigerator case 12 can be adjusted by removal and reinsertion of elements 28 in provisions 14.

Due to the vertical efficiency of system 10 according to the teachings of the present invention, it is not necessary to stack the products one on top of another as was typically done in prior refrigerated shelving systems. It should then be appreciated that restocking product can be accomplished in an easier, less labor intensive manner. Particularly, shelving system 10 according to the preferred teachings of the present invention results in a labor reduction in the range of ½ to ⅓ over prior horizontal shelves having product stacked three high.

Now that the basic teachings of the present invention have been explained, many extensions and variations will be obvious to one having ordinary skill in the art. For example, in the preferred form, shelving system 10 incorporates several unique features believed to produce synergistic results. However, it can be appreciated that such features can be utilized separately or in a variety of other combinations according to the teachings of the present invention. For example, features of the present invention may have applicability to products which are retailed in multipack-type packaging.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. A shelving system for relatively fragile product having a base and a height comprising, in combination: at least a first tray, adapted to be supported upon a shelf, for holding a plurality of fragile product in a single lane having an initial product followed by a succeeding product, with the tray having a front edge and a back edge vertically elevated above the front edge so that the product tends to slide in the tray under gravitational forces towards the front edge; and a flexible stop extending over the front edge to a height in the range of one-third to one-half of the height of the product and secured to the tray to prevent the fragile product from sliding off the front edge of the tray, with the stop having a flexibility to allow flexing when the initial product is manually removed from the front of the tray, to allow its return to a stopping position after the initial product is removed to abut with the succeeding product, and to allow cushioning of and stopping the succeeding product sliding toward the front edge of the tray.

2. The shelving system of claim 1 wherein the flexible stop extends at an acute angle in the order of 70° to the tray.

3. The shelving system of claim 2 wherein the flexible stop is transparent.

4. The shelving system of claim 1 wherein the tray extends downwardly at a gentle angle in the order of 5.5° from the back edge to the front edge.

5. The shelving system of claim 1 further comprising, in combination: a second tray, with the second tray held vertically above and generally parallel to the first tray and spaced a distance slightly greater than the height of the fragile product, with the spacing between the stop and the second tray being less than the height of the fragile product.

6. The shelving system of claim 1 further comprising, in combination: means for reducing the sliding friction of the fragile product with the tray.

7. The shelving system of claim 6 wherein the reducing means comprises parallel ribs upstanding from the tray for engaging the base of the product.

8. The shelving system of claim 1 for at least first and second types of relatively fragile products each having a base, with the first and second types of relatively fragile products having differing shapes and having differing sizes of bases, with the second type of relatively fragile product having a maximum horizontal dimension other than at the base; wherein the second tray includes a sheet for slideably supporting the bases of the second type of relatively fragile products and means extending from the sheet for retaining the second type of relatively fragile products in a straight line on the sheet, with the sheet of the second tray having a width generally equal to the horizontal dimension of the base of the second type of relatively fragile product and includes first and second edges; and wherein the second tray further comprises first and second protrusions extending from the first and second edges of the sheet of the second tray to an extent equal to the maximum horizontal dimension of the second type of relatively fragile product, with the protrusions of the second tray adapted to abut with an adjacent tray.

9. A shelving system for at least first and second types of relatively fragile products each having a base, with the first and second types of relatively fragile products having differing shapes and having differing sizes of bases, comprising, in combination: a first shelf having a rear edge; a first tray including a sheet for slideably supporting the bases of the first type of relatively fragile products and means extending from the sheet for retaining the first type of relatively fragile products in a straight line on the sheet; a second tray including a sheet for slideably supporting the bases of the second type of relatively fragile products and means extending from the sheet for retaining the second type of relatively fragile products in a straight line on the sheet; means formed on the first shelf and the first and second trays for removably securing the trays to the first shelf so that either of the first and second trays can be secured to the first shelf; a second shelf supported above the first shelf, with the removably securing means also formed on the second shelf so that either of the first and second trays can be secured to the second shelf independent of the trays secured to the first shelf; means for exclusively supporting the second shelf by the first shelf so that the second shelf is supported above the first shelf; and means formed on the rear edge of the first shelf for removably attaching the first shelf to an outside support, with the first shelf being exclusively supported by the rear edge to the outside support.

10. The shelving system of claim 9 wherein the exclusively supporting means includes means for adjustably securing the second shelf to the first shelf at differing spacings between the first and second shelves.

11. The shelving system of claim 9 wherein the trays have a front edge and a back edge which is vertically elevated above the front edge when secured to the first shelf so that the relatively fragile product tends to slide in the trays under gravitational forces towards the front edge; and wherein the trays extend downwardly at an angle in the order of 5.5° from the back edge to the front edge.

12. The shelving system of claim 9 wherein the retaining means of the first tray comprises first and second, parallel upright walls extending from the sheet of the first tray, with the sheet of the first tray having a width generally equal to the base of the first type of relatively fragile product and first and second edges, with the first and second walls provided along the first and second edges so that the first tray is U-shaped, with the upright walls of the first tray adapted to abut with an adjacent tray; wherein the second type of relatively fragile product has a maximum horizontal dimension other than at the base; wherein the sheet of the second tray has a width generally equal to the horizontal dimension of the base of the second type of relatively fragile product and includes first and second edges; and wherein the second tray further comprises first and second protrusions extending from the first and second edges of the sheet to an extent equal to the maximum horizontal dimension of the second type of relatively fragile product, with the protrusions of the second tray adapted to abut with an adjacent tray.

13. A shelving system for at least first and second types of relatively fragile products each having a base, with the first and second types of relatively fragile products having differing shares and having differing sizes of bases, wherein the second type of relatively fragile product has a maximum horizontal dimension other than at the base, comprising, in combination: a first shelf; a first tray including a sheet for slideably supporting the bases of the first type of relatively fragile products and means extending from the sheet for retaining the first type of relatively fragile products in a straight line on the sheet; a second tray including a sheet for slideably supporting the bases of the second type of relatively fragile products and means extending from the sheet for retaining the second type of relatively fragile products in a straight line on the sheet; and means formed on the first shelf and the first and second trays for removably securing the trays to the first shelf so that either of the first and second trays can be secured to the first shelf; wherein the sheet of the second tray has a width generally equal to the horizontal dimension of the base of the second type of relatively fragile product and includes first and second edges; and wherein the second tray further comprises first and second protrusions extending from the first and second edges of the sheet to an extent equal to the maximum horizontal dimension of the second type of relatively fragile product, with the protrusions of the second tray adapted to abut with an adjacent tray.

14. The shelving system of claim 13 wherein the retaining means of the first tray comprises first and second, parallel upright walls extending from the sheet, of the first tray with the sheet of the first tray having a width generally equal to the base of the first type of relatively fragile product and first and second edges, with the first and second walls provided along the first and second edges so that the first tray is U-shaped, with the upright walls of the first tray adapted to abut with an adjacent tray.

15. The shelving system of claim 14 further comprising, in combination: a second shelf supported above the first shelf, with the removably securing means also formed on the second shelf so that either of the first and second trays can be secured to the second shelf independent of the trays secured to the first shelf.

16. The shelving system of claim 13 wherein the trays have a front edge and a back edge which is vertically elevated above the front edge when secured to the first shelf so that the relatively fragile product tends to slide in the trays under gravitational forces towards the front edge; and wherein the trays extend downwardly at an angle in the order of 5.5° from the back edge to the front edge.

17. The shelving system of claim 13 further comprising, in combination: a second shelf supported above the first shelf, with the removably securing means also formed on the second shelf so that either of the first and second trays can be secured to the second shelf independent of the trays secured to the first shelf; means for exclusively supporting the second shelf by the first shelf so that the second shelf is supported above the first shelf, with the first shelf having a rear edge; and means formed on the rear edge of the first shelf for removably attaching the first shelf to an outside support, with the first shelf being exclusively supported by the rear edge to the outside support.

18. A shelving system for individual thin wall containers of a refrigerated product having thixotropic properties, with the containers having planar bases, comprising, in combination: at least a first tray for holding a plurality of containers in a single lane, with the tray having a planar top surface, a front edge and a back edge, with the bases of the containers being supported on the planar top surface, with the back edge being vertically elevated above the front edge so that the bases of the containers tend to slide on the planar top surface under gravitational forces towards the front edge; and a flexible stop, secured to the first tray, for preventing the containers from sliding past the front edge while tending to resiliently bend forward under forces due to engagement with a respective sliding container with the planar top surface extending at a gentle angle in the order of 5.5° sufficient to start sliding of the bases of the containers on the planar top surface without external forces other than gravitational forces while maintaining the speed of the sliding containers so that the containers do not slide at a speed sufficient to leave the first tray.

19. The shelving system of claim 18 further comprising, in combination: means for reducing the sliding friction of the fragile product with the first tray.

20. The shelving system of claim 19 wherein the reducing means comprises parallel ribs upstanding from the first tray for engaging the base of the product.

* * * * *